US009180590B1

(12) United States Patent
Ou

(10) Patent No.: US 9,180,590 B1
(45) Date of Patent: Nov. 10, 2015

(54) TOOL HANGER

(71) Applicant: Yu-Hua Ou, Taichung (TW)

(72) Inventor: Yu-Hua Ou, Taichung (TW)

( * ) Notice: Subject to any disclaimer, the term of this patent is extended or adjusted under 35 U.S.C. 154(b) by 3 days.

(21) Appl. No.: 14/274,712

(22) Filed: May 10, 2014

(51) Int. Cl.

| | |
|---|---|
| ***B65D 85/28*** | (2006.01) |
| ***A47F 7/00*** | (2006.01) |
| ***B25H 3/00*** | (2006.01) |
| ***B65D 25/22*** | (2006.01) |

(52) U.S. Cl.
CPC ..... *B25H 3/003* (2013.01); *B65D 25/22* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,535,882 | A * | 7/1996 | Liu | 206/377 |
| 5,931,318 | A * | 8/1999 | Shauo | 211/70.6 |
| 6,401,923 | B1 * | 6/2002 | Huang | 206/376 |
| 8,408,388 | B1 * | 4/2013 | Chen | 206/45.24 |
| 8,550,244 | B1 * | 10/2013 | Ou | 206/378 |
| 2002/0070185 | A1 * | 6/2002 | Chen | 211/70.6 |
| 2003/0141211 | A1 * | 7/2003 | Tsai | 206/378 |
| 2003/0213760 | A1 * | 11/2003 | Lee | 211/70.6 |
| 2006/0070902 | A1 * | 4/2006 | Tuan-Mu et al. | 206/378 |

* cited by examiner

*Primary Examiner* — Jacob K Ackun

(57) ABSTRACT

A tool hanger for at least carrying at least one socket is provided, including a main body and a combination member. The main body is formed with a hanging portion at one end and includes a first surface, a second surface and two lateral surfaces. Each of the two lateral surfaces is formed with at least one securing portion for assembling with the sockets. The combination member is pivoted to the main body and formed with two stopping members respectively on two ends. The combination member is rotatable relative to the main body so as to selectively close to or move away from the second surface. Wherein when the combination member is close to the second surface, the stopping member is located oppositely to and blocks one end of the socket opposite to the securing member so that the socket is undetachable from the securing portion.

9 Claims, 5 Drawing Sheets

TOOL HANGER

BACKGROUND OF THE INVENTION

1. Field of the Invention

The present invention relates to a tool hanger, and more particularly to a tool hanger at least for sockets.

2. Description of the Prior Art

A prior art of tool hanger is disclosed in TW M399017. Main bodies for assembling with the tools are independent to each other and serially connected with each other to form a long-rod-shaped tool hanger, wherein a protruding portion on a lateral surface of the main body is for assembling with a socket. The main body is formed with an assembling portion on the top and it is designed as a step-shaped protrusion. The internal of the main body is formed with a corresponding step-shaped concavity. The concavity is formed with a through hole for the other main body to connect with after the other main body inserts in. A barb is disposed on the end of the assembling portion to hook with the other main body so that they are detachable. A hanging plate is assembled on the top of the main body assembly, and a target for anti-theft and secure hanging is achieved. When the socket is taken out, an insertion of an inserting rod or a connection of the connecting rod is simply clipped with a cutting tool so that the socket is able to be taken out.

Although it has a good performance of securing while the tools are assembled on the tool hanger, however, after the tool hanger is damaged, the securing performance decreases. The tools can easily fall out from the tool hanger afterwards. So that it is inconvenient for repeating to use. The tool hanger of prior art is unable to give considerations to both a good strength of the structure and a repeatable usability. This disadvantage is needed to be improved.

The present invention has arisen to mitigate and/or obviate the afore-described disadvantages.

SUMMARY OF THE INVENTION

The primary object of the present invention is to provide a tool hanger with strong securing strength and repeatable usability.

To achieve the above object, a tool hanger for at least carrying at least one socket in accordance with present invention includes a main body and a combination member.

The main body is formed with a hanging portion at one end and includes a first surface, a second surface corresponding to the first surface and two lateral surfaces by two sides of the first surface and the second surface. Each of the two lateral surfaces is formed with at least one securing portion for assembling with the at least one socket.

The combination member is pivoted to the main body and formed with two stopping members respectively on two ends. The combination member is rotatable relative to the main body so as to selectively close to or move away from the second surface. Wherein when the combination member is close to the second surface, the stopping member is located oppositely to and blocks one end of the socket opposite to the securing member so that the socket is undetachable from the securing portion.

The socket is able to be secured via controlling the rotation of the combination member. The socket is also able to be taken out after the combination member rotates to move away from the second surface, and the structure is undamaged. The tool hanger includes both a good performance of securing and a repeatable usability.

DETAILED DESCRIPTION OF THE PREFERRED EMBODIMENTS

Figure 1:
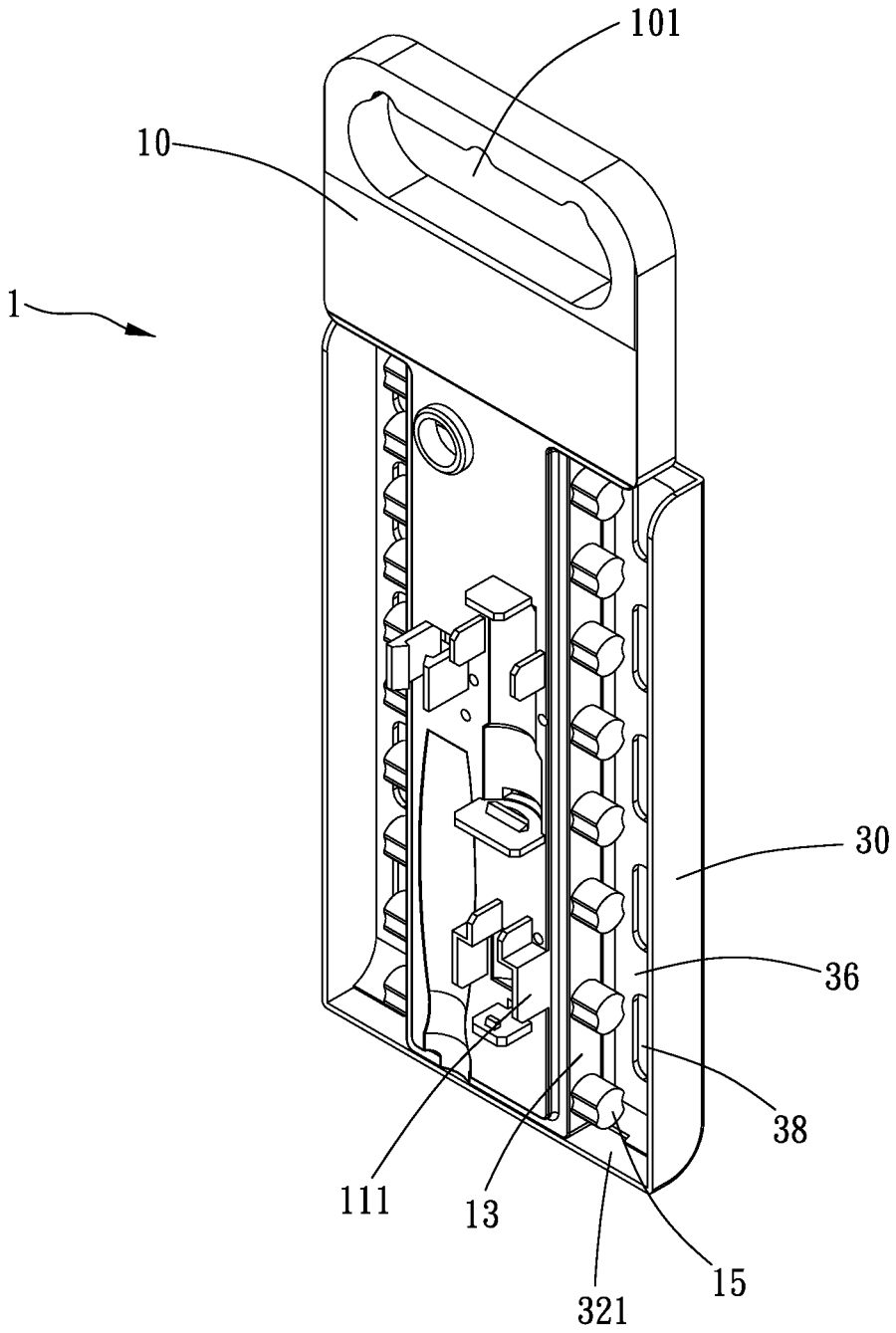
FIG. 1 is a three-dimensional drawing showing a preferable embodiment of the present invention.
Figure 3:
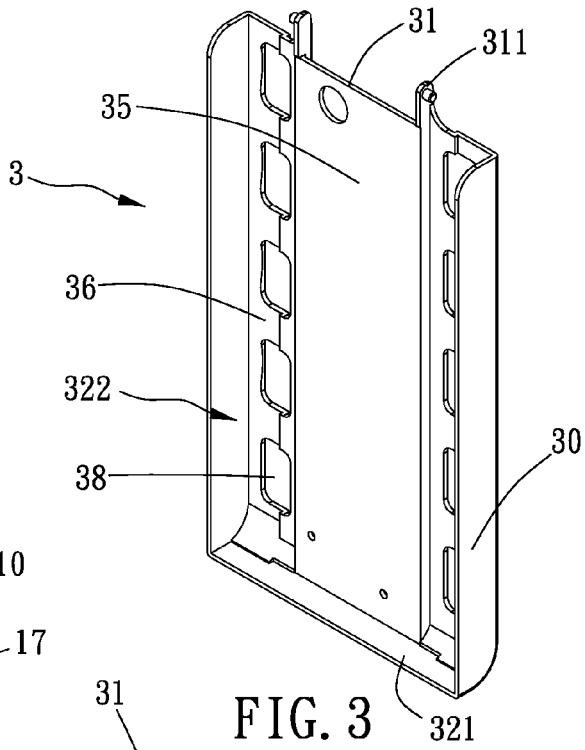
FIG. 3 is a three-dimensional drawing showing the combination member of the present invention.
Figure 2:
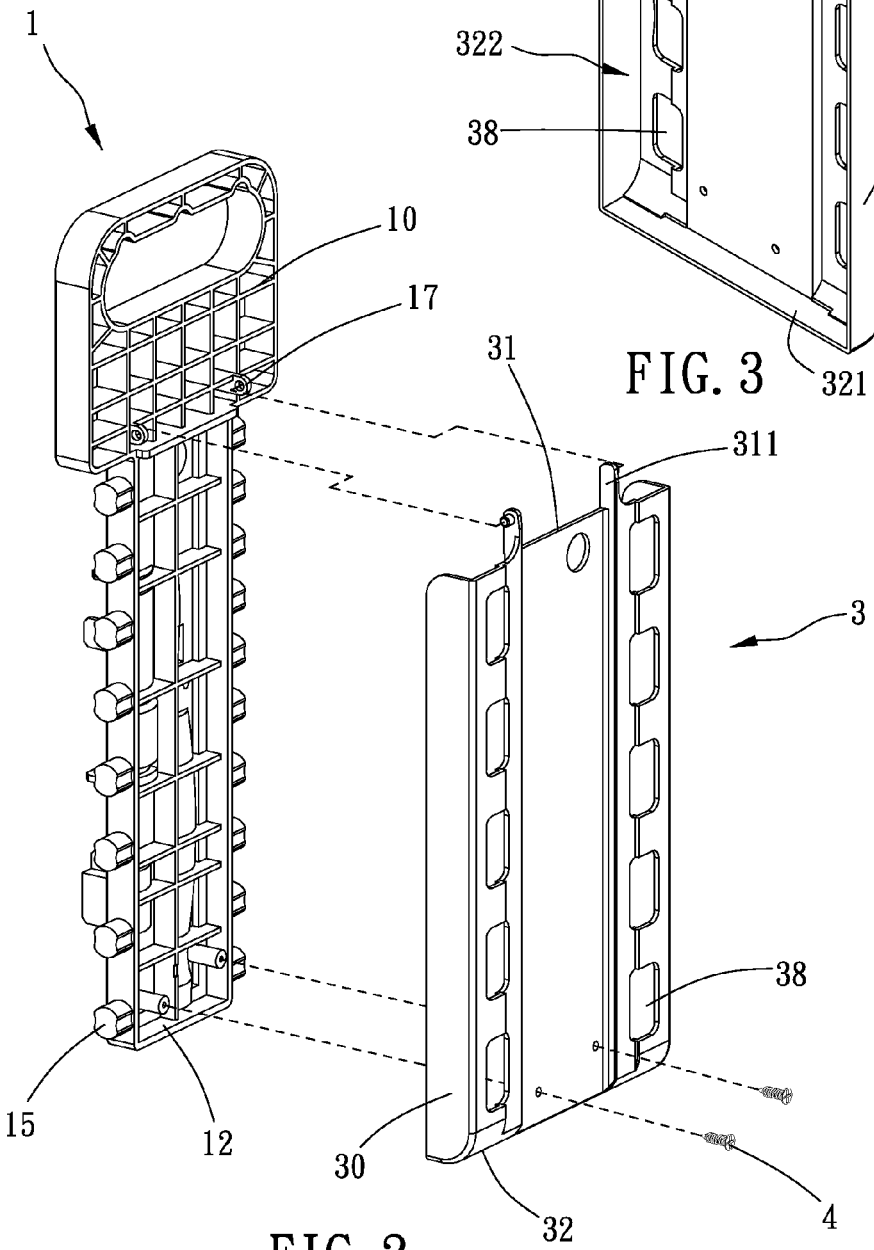
FIG. 2 is a breakdown drawing showing the preferable embodiment of the present invention.

The present invention will be clearer from the following description when viewed together with the accompanying drawings, which show, for purpose of illustrations only, the preferred embodiment in accordance with the present invention.

Referring to FIGS. 1-4, a tool hanger is for at least carrying at least one socket and comprises a main body 1 and a combination member 3.

The main body 1 is flat-plate-shaped, and the main body 1 is formed with a hanging portion 10 at one end. In the present embodiment, the hanging portion 10 includes a hanging hole 101 (in other embodiments, the hanging hole is replaceable with hook members or other hanging structures). The main body 1 includes a first surface 11, a second surface 12 corresponding to the first surface 11 and two lateral surfaces 13 by two sides of the first surface 11 and the second surface 12, and each of the two lateral surfaces 13 is formed with at least one securing portion 15 for assembling with the at least one socket 5. The securing portions 15 are arranged along a direction in which the first and second surfaces 11, 12 extend, and each of the securing portions 15 is cylinder-shaped and for assembling with the socket 5.

The combination member 3 is pivoted to the main body 1 and formed with two stopping members 30 respectively on two ends. The two stopping members 30 are bent from and formed on the two ends of the combination member 3. A cross section of the combination member 3 and the two stopping members 30 is ∩-shaped. The combination member 3 is rotatable relative to the main body 1 so as to selectively close to or move away from the second surface 12.

In the present embodiment, the combination member 3 includes a first end 31 and a second end 32 opposite to each other, and the combination member 3 also includes a connecting surface 35 and two abutting surfaces 36 locating on two ends of the connecting surface 35.

The first end 31 pivotally connects with the main body 1. Specifically, the main body 1 is formed with two first pivot ears 17 on the second surface 12 close to the hanging portion 10. The first end 31 is formed with two second pivot ears 311, and each of the first pivot ears 17 connects with each of the second pivot ears 311. The second end 32 includes an end plate 321. The end plate 321 connects with the two stopping member 30 at two ends. The end plate 321 and the two stopping members 30 construct a receiving space 322 to be ∩-shaped. The connecting surface 35 is for resting on the second surface 12, and each of the abutting surfaces 36 locates between the connecting surface 35 and one the stopping member 30.

Figure 4:
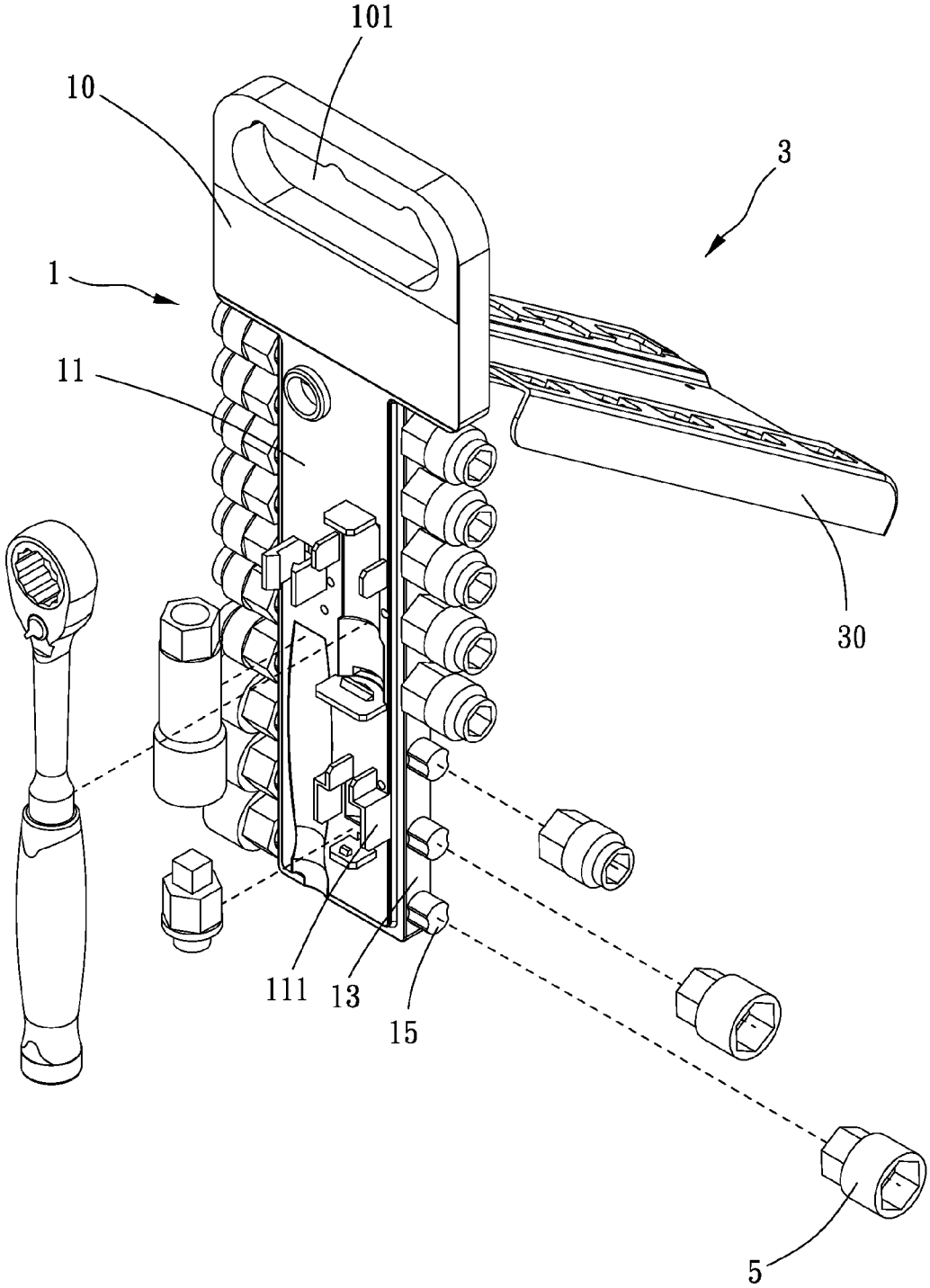
FIGS. 4-6 are perspective drawings showing the preferable embodiment of the present invention in use.
Figure 5:
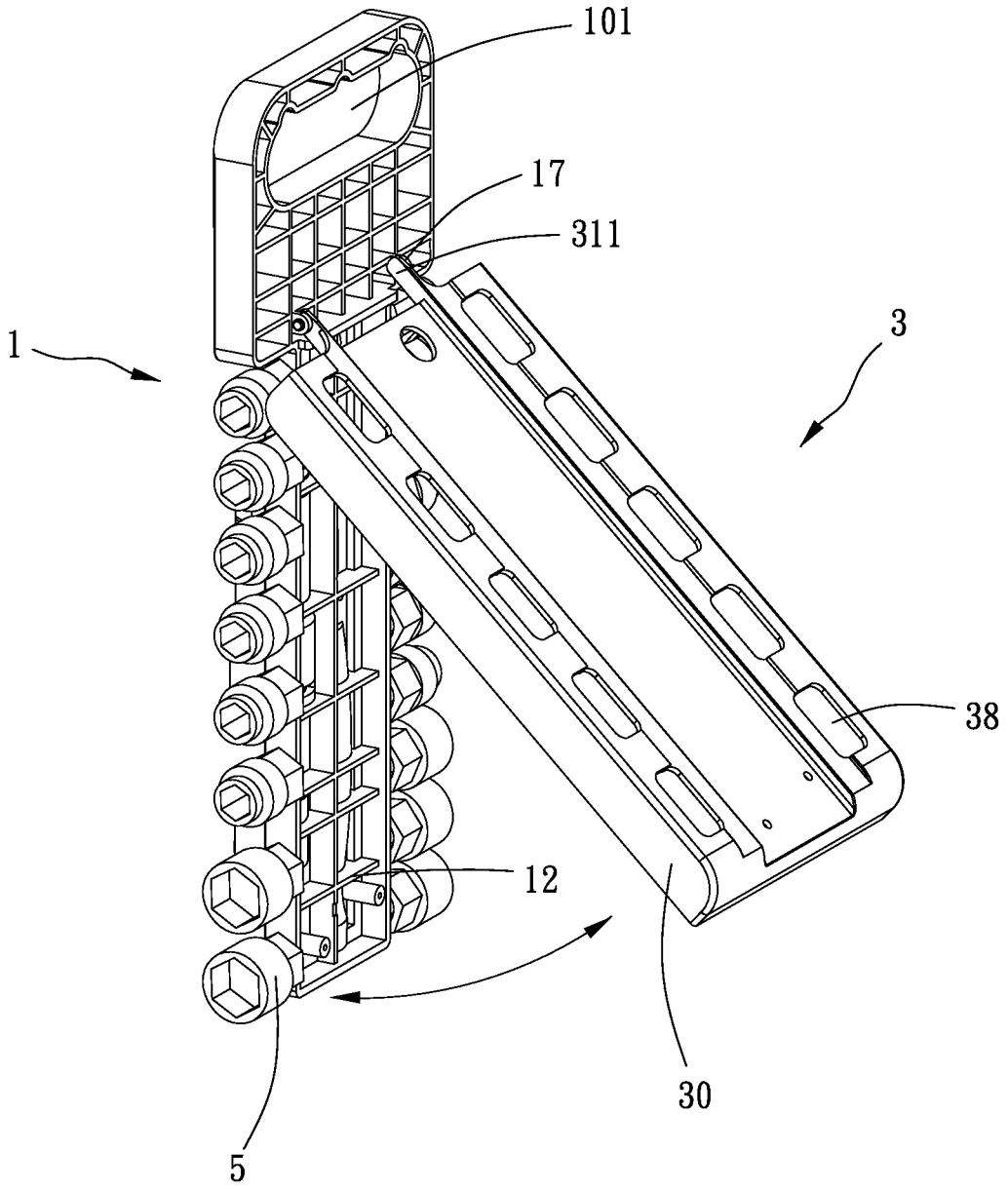
Figure 6:
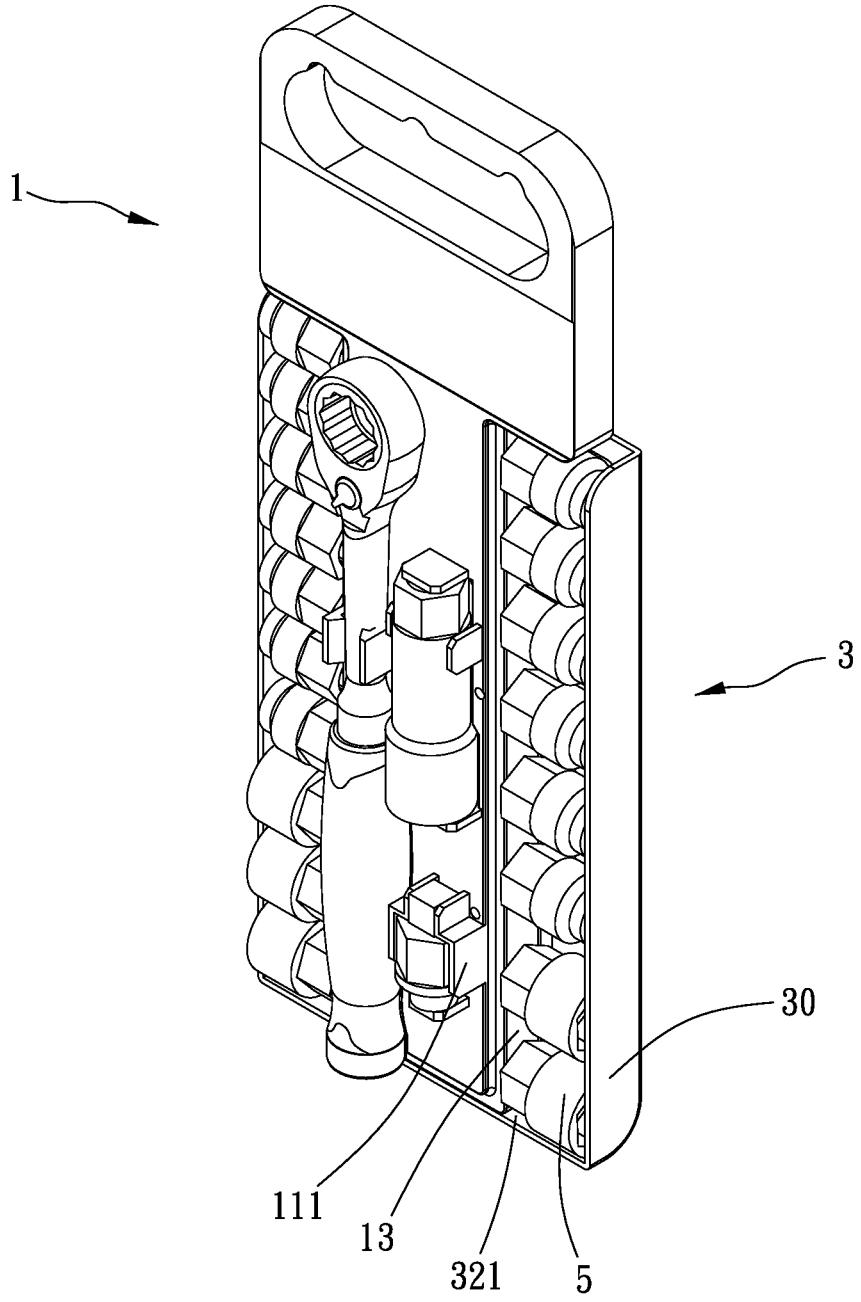

So that a plurality of the sockets 5 are able to be assembled on the securing portions 15 (shown in FIGS. 4-6). After the sockets 5 are assembled, the combination member 3 is driven to pivot and secure the sockets 5.

When the combination member 3 is close to the second surface 12 of the main body 1 (shown in FIG. 3 and FIG. 6), the main body 1 is disposed in the receiving space 322 and between the two stopping members 30.

The end plate 321 and the two stopping members 30 surround a bottom and the two sides of the main body 1. The lateral surface 13, the abutting surface 36 and the stopping member 30 surround one the socket 5. The stopping member 30 is located oppositely to and blocks one end of the socket 5 opposite to the securing member 15 so that the socket 5 is undetachable from the securing portion 15 because of the obstruction of the stopping member 30.

So that when the combination member 3 is close to the second surface 12 of main body 1, the stopping member 30 blocks the socket 5 and the socket 5 is undetachable from the securing portion 15. The socket 5 is secured and anti-theft.

When the socket 5 is taken out, the combination member 3 is driven to rotate and move away from the second surface 12 of the main body 1 to unlock (shown in FIG. 5). After the stopping member 30 moves away from the socket 5, the socket 5 is able to be taken out from the securing portion 15.

Besides, in order to increase the strength of securing, the present embodiment further includes a plurality of fasteners 4. The fastener 4 is such as a screw in the present embodiment. When the combination member 3 is close to the second surface 12, the combination member 3 and the main body 1 are selectively detachably fixed with each other by the fasteners 4. The socket 5 is completely fixed because the fasteners 4 fixe the combination member 3 and makes it unable to move.

The main feature of the present invention is to control the rotation of the combination member 3 and so that the socket 5 is able to be secured. It is convenient for using. And when the combination member 3 is close to the main body 1, the sockets 5 assembling on both two lateral surfaces are secured. It is fast for securing the sockets 5 and unlocking it. Furthermore, during the process of securing or unlocking, it is unnecessary to damage the structure, so that the structure remains complete and durable. The tool hanger includes both a good performance of securing and a repeatable usability.

It is noted that in the present embodiment, the abutting surface 36 is formed with at least one hole 38. When the socket 5 is oversized, it dives in the hole 38 so that the combination member 3 is substantially laminated on the second surface 12. Furthermore, each of the holes 38 allows users to look through the combination member 3 and see the socket 5 assembled inside. Also, it saves the material and decreases the weight.

Furthermore, in the present embodiment, the first surface 11 is formed with an assembling portion 111 for assembling with at least one tool. The assembling portion 111 includes a plurality of hook members. Each of the hook members is for securing wrenches, screws or other tools. So that the storage number for tools is increased. In other embodiments, the assembling portion 111 can be an inserting hole or other structures, and it depends on the type of the tools.

While we have shown and described various embodiments in accordance with the present invention, it should be clear to those skilled in the art that further embodiments may be made without departing from the scope of the present invention.

What is claimed is:

1. A tool hanger, for at least carrying at least one socket, the tool hanger comprising:

a main body, formed with a hanging portion at one end, including a first surface, a second surface corresponding to the first surface and two lateral surfaces by two sides of the first surface and the second surface, each of the two lateral surfaces being formed with at least one securing portion or securing member for assembling with the at least one socket;

a combination member, pivoted to the main body and formed with two stopping members respectively on two ends, the combination member being rotatable relative to the main body so as to selectively close to or move away from the second surface, wherein when the combination member is close to the second surface, the stopping member is located oppositely to and blocks one end of the socket opposite to the securing member so that the socket is undetachable from the securing portion.

2. The tool hanger as claimed in claim 1, wherein the two stopping members are bent from and formed on the two ends of the combination member, a cross section of the combination member and the two stopping members is ∩-shaped, and when the combination member is close to the second surface, the main body is located between the two stopping members.

3. The tool hanger as claimed in claim 1, wherein the combination member includes a first end and a second end opposite to each other, the first end pivotally connects with the main body, the second end includes an end plate, the end plate connects with the two stopping member at two ends, the end plate and the two stopping members construct a receiving space, when the combination member is close to the second surface, the main body locates in the receiving space and the end plate and the two stopping members surround a bottom and the two sides of the main body.

4. The tool hanger as claimed in claim 3, wherein the main body is formed with two first pivot ears on the second surface close to the hanging portion, the first end is formed with two second pivot ears, and each of the first pivot ears connects with each of the second pivot ears.

5. The tool hanger as claimed in claim 1, wherein the combination member includes a connecting surface and two abutting surfaces locating on two ends of the connecting surface, the connecting surface is for resting on the second surface, each of the abutting surfaces locates between the connecting surface and one the stopping member, and when the combination member is close to the second surface, the corresponding lateral surface, abutting surface and stopping member surround one the socket.

6. The tool hanger as claimed in claim 5, wherein the abutting surface is formed with at least one hole.

7. The tool hanger as claimed in claim 1, wherein the lateral surface is formed with a plurality of the securing portions, and the securing portions are arranged along a direction in which the first and second surfaces extend.

8. The tool hanger as claimed in claim 1, wherein the first surface is formed with an assembling portion for assembling with at least one tool.

9. The tool hanger as claimed in claim 1, further including a plurality of fasteners, and when the combination member is close to the second surface, the combination member and the main body are selectively detachably fixed with each other by the fasteners.

* * * * *